United States Patent [19]

Edwards

[11] 4,222,325

[45] Sep. 16, 1980

[54] MOUNTING MEANS FOR MOVABLE CARRIAGE ON AN OFFSET PRESS

[75] Inventor: Robert Edwards, Dudley, Mass.

[73] Assignee: White Consolidated Industries, Inc., Cleveland, Ohio

[21] Appl. No.: 936,826

[22] Filed: Aug. 25, 1978

[51] Int. Cl.[3] ..... B41F 7/08; B41F 7/40; B41F 31/34

[52] U.S. Cl. ..... 101/137; 101/148; 101/177; 101/185; 101/247; 101/351; 101/248

[58] Field of Search ..... 101/177, 183, 184, 185, 101/136, 137, 140, 141, 142, 143, 144, 145, 247, 209, 351, 352, 178, 182, 138, 139, 179, 180, 181, 148

[56] References Cited

U.S. PATENT DOCUMENTS

| | | | |
|---|---|---|---|
| 3,041,966 | 7/1962 | Polglase, Jr. | 101/139 |
| 3,516,289 | 6/1970 | MacGeorge et al. | 101/349 X |
| 3,521,559 | 7/1970 | Sejeck et al. | 101/248 X |
| 3,991,674 | 11/1976 | Petri | 101/349 X |
| 4,056,056 | 11/1977 | Giori | 101/177 |

OTHER PUBLICATIONS

Thomson Ball Bushings for Linear Motion, Ball Bushing Catalog Form, 139, (Dec., 1976), Thomson Industries, Inc., Manhasset, N.Y.

*Primary Examiner*—J. Reed Fisher
*Attorney, Agent, or Firm*—Pearne Gordon Sessions

[57] ABSTRACT

A two-color offset printing press having two plate cylinders simultaneously engageable with a single blanket cylinder is disclosed. The plate cylinders and a blanket cylinder are rotatably mounted on a printer head fixed to the mainframe of the press. A first set of dampening and inking rollers is mounted on the printer head and engageable with one of the plate cylinders. A second set of dampening and inking rollers, engageable with the other plate cylinder, is mounted on a ball bushing supported carriage linearly movable to and from the printer head along a pair of parallel rails fixed to the mainframe. Image registry between the two plate cylinders is established by an operator-accessible adjustment mechanism for shifting one of the plate cylinders back and forth along its axis of rotation. An electrical safety interlock system precludes operator access to the carriage-associated plate cylinder during predetermined operating modes of the press.

2 Claims, 13 Drawing Figures

FIG. 8
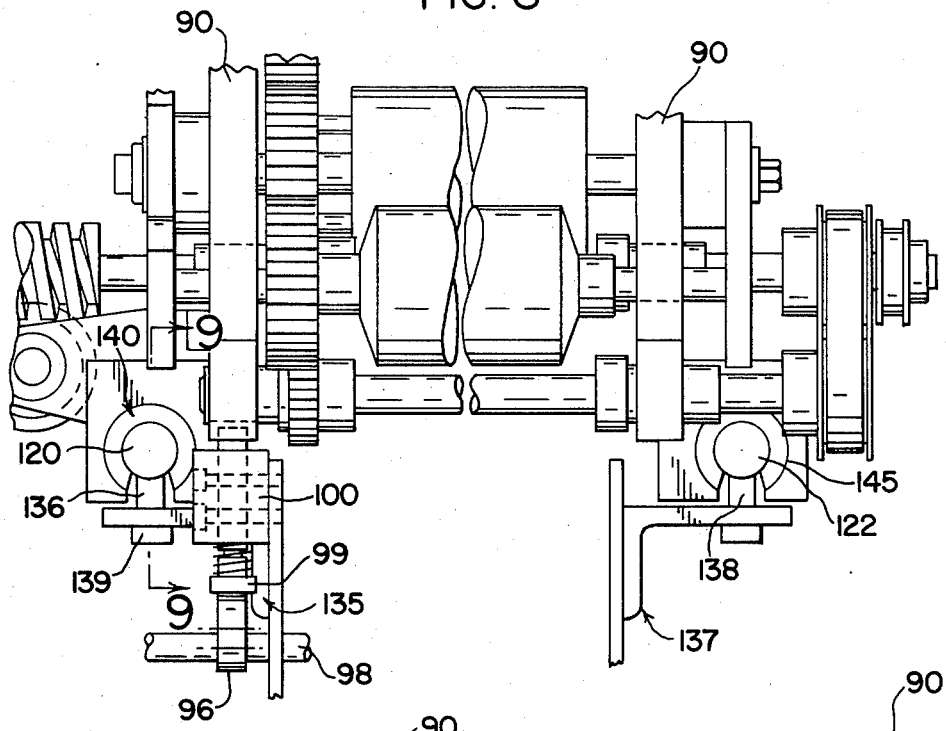
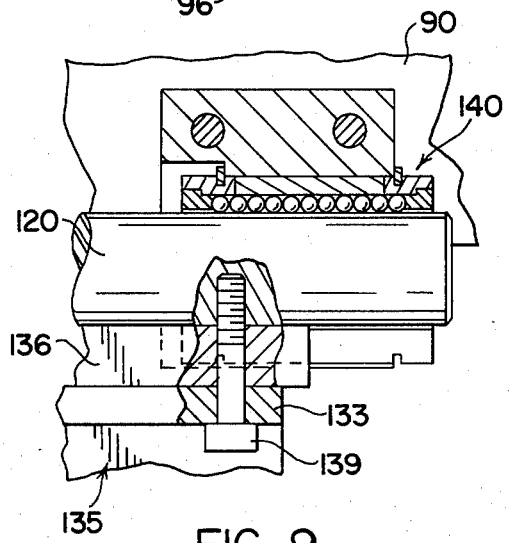
FIG. 9
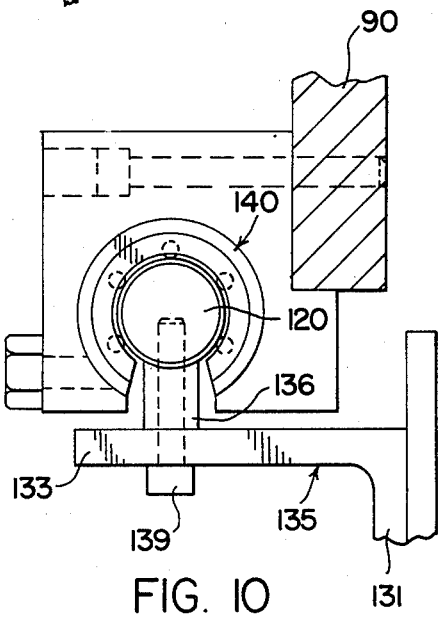
FIG. 10

MOUNTING MEANS FOR MOVABLE CARRIAGE ON AN OFFSET PRESS

BACKGROUND OF THE INVENTION

This invention relates to offset printing, and in particular to an offset printing press having a dampening and inking roller-containing carriage linearly movable to and from an associated plate cylinder.

The set of dampening and inking rollers on the carriage, when moved to an engagement position with a respective plate cylinder, must be properly positioned relative to the plate cylinder to provide controlled amounts of inking and dampening fluid to the plate cylinder. To provide such proper positioning, it is necessary that lateral and skewing movements of the linearly movable carriage be eliminated.

The prior art, as represented by U.S. Pat. No. 3,521,559 to Sejeck et al., is intended to provide proper positioning of a linearly movable ink roller-containing carriage relative to its respective plate cylinder by the use of interlocking abutting slide members of wear-resistant, low friction, synthetic resin. The slide members are intended to preclude lateral shifting or skewing of the carriage to provide for proper positioning of the carriage-contained ink rollers relative to their respective plate cylinder. Such a slide arrangement is further intended to give all the benefits of a more expensive machined dovetail slide arrangement.

While the Sejeck et al. slide arrangement may represent a cost improvement over a conventional dovetail type slide, such a slide arrangement would still be susceptible to surface-to-surface sliding friction wear as is a dovetail-type slide. Further, the weight of the moving carriage may have to be limited to prevent degeneration of the relatively soft synthetic resin material used to form the Sejeck et al. carriage-supporting slide members.

SUMMARY OF THE INVENTION

In accordance with the present invention, a printer head, including at least one rotatably mounted blanket cylinder and at least one rotatably mounted plate cylinder engageable with the blanket cylinder, is mounted on and fixed to a mainframe which supports a dampening and inking roller-containing carriage linearly movable to and from the printer head on a set of rolling-friction bearing surfaces. The carriage is positively lockable at predetermined locations lying along its linear path of movement to and from the printer head. In a preferred form the invention includes a plurality of linear motion ball bushings fixed to the carriage. The bushings in turn ride on a pair of mainframe-supported circular cross section rails that are parallel to and lie along either side of an axis normal to the axis of rotation of the plate cylinder which engages the set of dampening and inking rollers on the movable carriage when it is in an engagement position closest to the printer head.

The invention provides accurate linear movement of the carriage relative to its associated plate cylinder without lateral or skewing movements of the carriage, such positive linear motion precluding misalignment of the plate cylinder and its carriage-mounted set of dampening and inking rollers. Linear carriage movement is provided by the present invention at a relatively low cost and with high reliability. The rolling friction bearing surfaces provided by the preferred linear motion ball bushings in accordance with the invention advantageously provide extremely low friction movement of the carriage as opposed to the higher surface-to-surface friction slide mechanism of the prior art.

BRIEF DESCRIPTION OF THE DRAWINGS

FIG. 8 is an end view of the press carriage, with portions cut away, taken along line 10—10 of FIG. 5;

FIG. 9 is a longitudinal, cross section view of one of the ball bushing mountings of the carriage taken along line 9—9 of FIG. 8;

FIG. 10 is a transverse, cross section view of one of the ball bushing mountings of the carriage taken along line 10—10 of FIG. 5;

DETAILED DESCRIPTION OF THE PREFERRED EMBODIMENT

Figure 1:
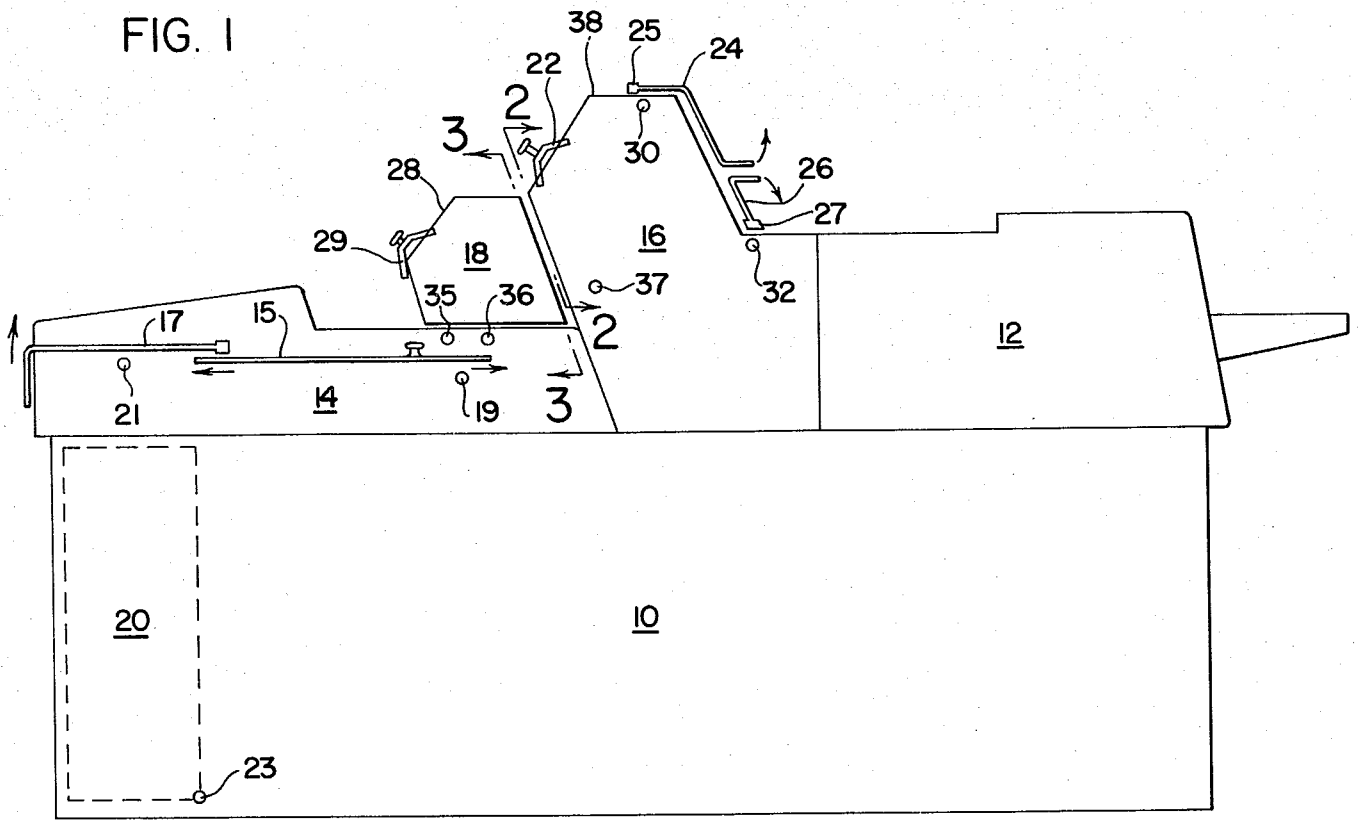
FIG. 1 is a schematic elevation view from the operator's side of a two-color offset printing press, with covers in place, in accordance with the present invention.

With reference to FIG. 1, there is schematically illustrated in elevation a two-color offset printing press in accordance with the present invention wherein a mainframe 10 having a paper feed input 12 and a paper delivery output 14, supports a fixed printer head 16 and a carriage 18 linearly movable to and from the printer head 16.

The printer head 16 includes a pair of plate cylinders engageable with a blanket cylinder, in turn engageable with an impression cylinder, in turn engageable with a delivery cylinder. The printer head 16 further includes a first set of dampening and inking rollers engageable with one of the plate cylinders.

The movable carriage includes a second set of dampening and inking rollers engageable with the other plate cylinder mounted on the printer head.

The detailed structure of the printer head 16 and carriage 18 will be illustrated and discussed subsequently.

By way of example, and with further reference to FIG. 1, in a typical offset printing operation, blank printing paper in a stream of sequentially fed separate sheets, is provided by the paper feed input 12 to the printer head 16 wherein the paper passes between the image-containing blanket cylinder and an impression cylinder, the image on the blanket cylinder being transferred in a well-known manner to the paper. The printed paper is then transferred via the paper delivery output 14 from the printer head 16 into a conventional vertically extending sheet stacking bin 20. The feeding of the printing paper to the printer head 16 by the paper feed input 12 and the delivery of the printed paper from the printer head 16 to the bin 20 by the paper delivery output 14 are provided by conventional chain transport systems well-known in the art.

To ensure safe operation of the press of the present invention, a plurality of fixed and movable covers are provided to limit operator access to moving parts of the press. The printer head 16 includes a cover 22 and two cooperating plate cylinder covers 24, 26, as shown in FIG. 1. The covers 22, 24, 26 serve to close printer head access openings used for maintenance or set-up of the press in a non-running condition. The plate cylinder covers 24, 26 are each pivotal about respective hinge joints 25, 27 fixed relative to the printer head 16. Associated with the covers 24, 26 are respective interlock switch means 30, 32 which are responsive to movement of their respective associated covers 24, 26 wherein opening and closing of the covers 24, 26 actuate the interlock switches 30, 32. In a manner to be subsequently explained in detail, opening of the covers 24, 26 by moving either of them pivotally away from the printer head 16 actuates the respective interlock switches 30, 32, which in turn deenergize the press drive motor to preclude operator access to moving press parts such as rotating cylinders and rollers mounted on and within the printer head 16. The cover 22 and movable covers 24, 26 cooperate with a printer head housing 38 to generally enclose the cylinder and rollers within the interior volume generally defined by the printer head housing 38.

The paper delivery output 14 includes a linearly slidable cover 15 and a cooperating pivotal cover 17, which limits operator access to the paper delivery chain drive when the paper delivery covers 15, 17 are in their closed position as illustrated in FIG. 1. Associated with the covers 15, 17 are respective interlock switch means 19, 21 which function to deenergize the press motor when the respective covers are in an open position as opposed to their closed illustrated positions. A bin overload interlock switch means 23 functions to deenergize the paper feed process when the bin 20 is full.

The carriage 18 includes a housing 28 and a cover 29 which generally encloses the interior mechanism of the dampening and inking roller-containing carriage 18, such mechanism to be explained subsequently in detail. Two carriage-related interlock switches 35, 36 are responsive to linear movement of the carriage 18 away from and toward the printer head 16. The carriage-related interlock switches 35 and 36 cooperate with a plate cylinder interlock switch means 37, the switching means 37 being responsive to the movement of a carriage-associated, printer head-mounted, plate cylinder into and out of an engaged position with the printer head-mounted blanket cylinder. The cooperating switch means 35, 36, 37 function together to limit operator access to moving parts within the printer head housing 38 and the carriage housing 28 when the carriage 18 is pulled back away from the printer head 16.

The heretofore discussed switch means are preferably in the form of mechanical microswitches, although other types of switches, such as optical coupler-type relays, are clearly applicable. The precise manner in which the above-noted plurality of interlocking switching means cooperate to deenergize the press motor to preclude unsafe operation of the press will be subsequently explained in detail.

Figure 2:
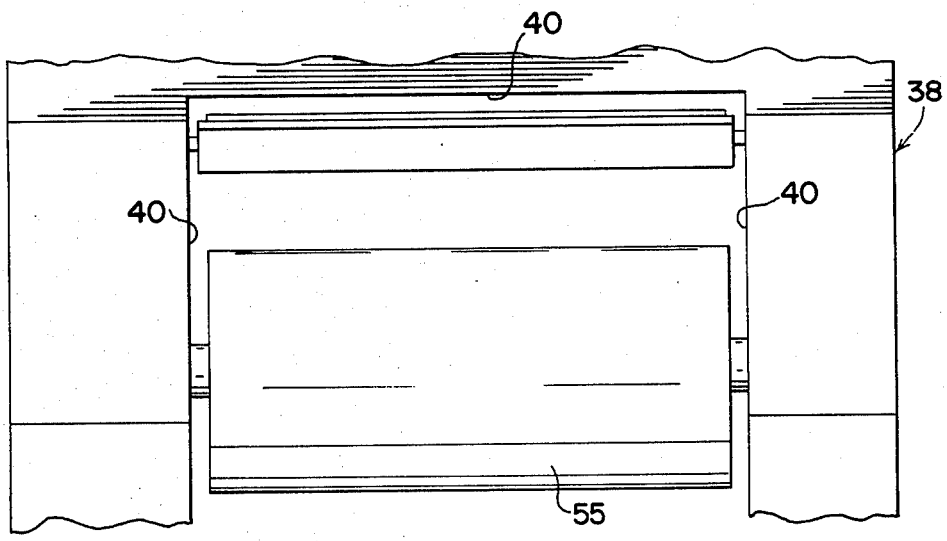
FIG. 2 is an elevation view of the printer head of the press taken along line 2—2 of FIG. 1.

With reference to FIG. 2 taken along line 2—2 of FIG. 1, it can be seen that the printer head housing 38 provides an edge wall 40 which circumscribes and defines a rectangular aperture for operator access to the interior of the housing 38 containing the printer head-mounted cylinders and rollers.

Figure 3:
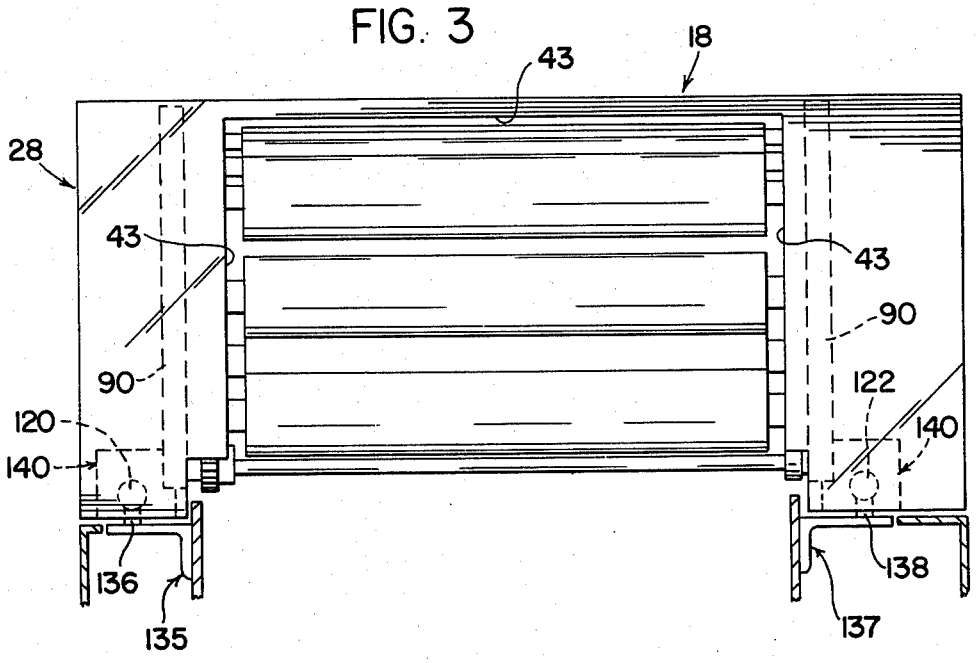
FIG. 3 is an elevation view of the movable carriage of the press taken along line 3—3 of FIG. 1.

With reference to FIG. 3 taken along line 3—3 of FIG. 1, it can be seen that the carriage housing 28 has an edge wall 43 which circumscribes and defines a rectangular aperture for access to the interior of the dampening and inking roller-containing carriage housing 28.

When the carriage 18 is pulled back or withdrawn away from the printer head 16 to a prescribed degree, operator access to both the interior of the carriage housing 28 and the interior of the printer head housing 38 is provided via the noted rectangular apertures. When the carriage 18 is moved to a position closest to the printer head 16, the housing edge walls 40, 43 abut in opposing relation (FIG. 1) to limit operator access to the interior of the housings 28 and 38 wherein the housings cooperate with each other and with the earlier-noted covers 22, 24, 26, 29 to generally enclose the cylinder and roller mechanisms of the printer head 16 and carriage 18, respectively.

Figure 4:
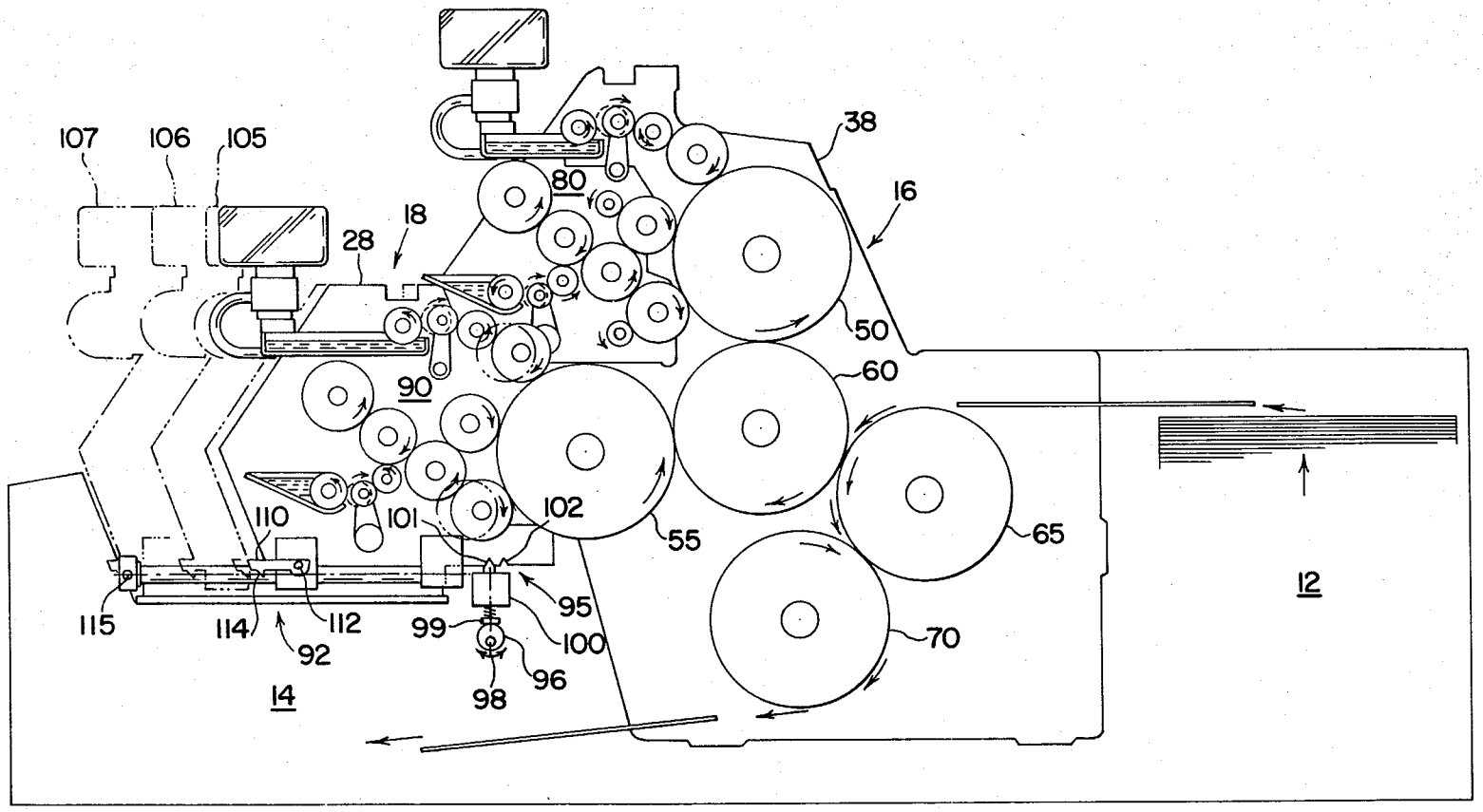
FIG. 4 is a schematic elevation view from the operator's side of the press, with covers removed.

Turning to FIG. 4, there is illustrated, in accordance with the invention and in a more detailed manner, the printer head 16 and the carriage 18, which are generally enclosed by their respective housings 28, 38, schematically represented in outline fashion. The printer head 16 includes a first plate cylinder 50, a second plate cylinder 55, a blanket cylinder 60, an impression cylinder 65, and a delivery cylinder 70.

The plate cylinders 50, 55, the blanket cylinder 60, the impression cylinder 65, and the delivery cylinder 70 are interengageable and rotatably mounted on the printer head 16. Each of the cylinders 50, 55, 60, 65, 70 lies along parallel axes of rotation with their outer surfaces of revolution in generally opposed, abutting relationship, as illustrated. Associated with and mounted on and fixed to the printer head 16 is a first set of dampening and inking rollers 80 rotatable on axes of rotation parallel to the axes of rotation of the printer head cylinders. The set of dampening and inking rollers 80 is conventional and functions to provide the first plate cylinder 50 with dampening and inking fluid in a well-known manner.

Associated with and mounted on and fixed to the movable carriage 18 is a second set of conventional dampening and inking rollers 90 located along axes parallel to those of the printer head cylinders. The second set of dampening and inking rollers functions to provide the second plate cylinder 55 with dampening and inking fluids as illustrated.

In a two-color printing operation, the carriage 18 is moved to an engagement position closest to the printer head 16, as illustrated in FIG. 4, wherein the second set of dampening and inking rollers 90 contacts the second plate cylinder 55, as illustrated, via the apertures defined by the carriage and printer head housing edge-walls 40,43 (See FIGS. 2 and 3). The first set of dampening and inking rollers 80 contacts the first plate cylinder 50.

In operation, the plate cylinders 50, 55 each contain, in wraparound fashion, a single-color image-carrying plate which is inked and dampened in a conventional manner by the sets of dampening and inking rollers 80, 90, the directions of cylinder and roller rotation being indicated in FIG. 4. Images from the plate cylinders 50, 55 are simultaneously transferred and superimposed in proper registry upon the blanket cylinder 60. The superimposed images on the blanket cylinder 60 are then simultaneously transferred to the blank printing paper fed between the blanket cylinder 60 and the impression cylinder 65. The printed paper is then stripped from the impression cylinder 65 by the delivery cylinder 70. The movement of the paper between the paper feed input 12 and the paper delivery output 14 defines a sinuous paper handling path extending therebetween, as illustrated in FIG. 4.

The process of printing on paper with two single-color plate cylinders cooperating with a blanket cylinder, which in turn cooperate with respective impression and delivery cylinders, is known in the art, as is a paper handling means generally illustrated in FIG. 4.

In accordance with the invention, the second plate cylinder 55 is rotatably mounted and fixed to the printer head 16, while its associated set of dampening and inking rollers 90 is mounted on and fixed to the movable carriage 18. The carriage 18 is preferably linearly movable to and from the second plate cylinder 55 in a manner to be subsequently explained and lockable at a predetermined number of positions along its travel length by means, of, for example, a detent mechanism 95 or a simple latch mechanism 92.

As illustrated in FIG. 4, the carriage is in an engagement position for a typical two-color offset printing operation as earlier discussed. In accordance with the invention, it can be seen that the detent mechanism 95 as shown in FIG. 4 locks the carriage 18 at the engagement position. The positive locking of the carriage is position by the detent mechanism 95 is accomplished by rotating an eccentrically mounted, vertically extending cam member 96 about a pivot pin 98. Rideable upon the outer upper edge of the cam member 96 is a spring-biased pin 99 which reciprocates to and from the carriage 18 upon a predetermined degree of rotation of the cam member 96. With the cam member 96 in a locking position as illustrated in FIG. 4, the pin 99, slidable upward through a collar 100 fixed relative to the press mainframe, projects into a receiving detent cavity 101 to positively lock the carriage at the illustrated engagement position.

As illustrated in phantom in FIG. 4, the carriage is leftwardly linearly movable back from the illustrated engagement position to a disengagement position 105 which is utilized when the press is operating in a single-color mode. Movement from the illustrated engagement position to the phantom-illustrated disengagement position 105 is accomplished by rotation of the cam member about its pivot pin 98 for approximately 180 degrees from its position illustrated in FIG. 4, causing the pin 99 to move downwardly and drop out of the detent cavity 101, wherein the operator pulls the carriage back away from the printer head 16 to the disengagement position 105, and wherein the cam member 96 is again rotated 180 degrees about the pivot pin 98 to push the pin 99 upward into a disengagement detent cavity 102 for positive locking of the carriage 18.

The carriage is also linearly movable to a further degree away from the printer head 16 to a wash-up position 106 at which the carriage is positively lockable by a mechanism similar to the detent mechanism 95 but not illustrated. It is further noted that the nonoperator side (FIG. 6) of the carriage 18 may include a detent locking mechanism which is opposite but substantially identical to the illustrated detent mechanism 97. The opposed detent mechanism and the illustrated operator side detent mechanism 97 can operate together via a common shaft extending across the carriage from the location of (and in substitution for) the pivot pin 98 to the pivot pin location of the opposed detent mechanism. Such a mechanism permits positive locking of both sides of the carriage 18.

The carriage is further movable to a lock-back position 107 farthest from the printer head 16, wherein positive locking of the carriage in the lock-back position 107 is provided by the pivotally movable latch member 110 mounted to the carriage via a pivot pin 112. As the carriage moves away from the printer head to the lock-back position, the latch member is raised up by a horizontally inclined camming surface 114 for latching engagement with a keeper 115 in the form of a horizontally projecting pin or rod fixed relative to the mainframe in a manner to be explained in more detail.

The rotatable mounting and fixing of the second plate cylinder 55 to the printer head ensures proper alignment between such second plate cylinder 55 and the blanket cylinder 60. The provision of a linearly movable carriage containing the set of dampening and inking rollers 90 which can be withdrawn from the second plate cylinder 55 advantageously permits ready access to the second plate cylinder and to the carriage-mounted dampening and inking rollers for set up procedures and usual maintenance.

Figure 5:
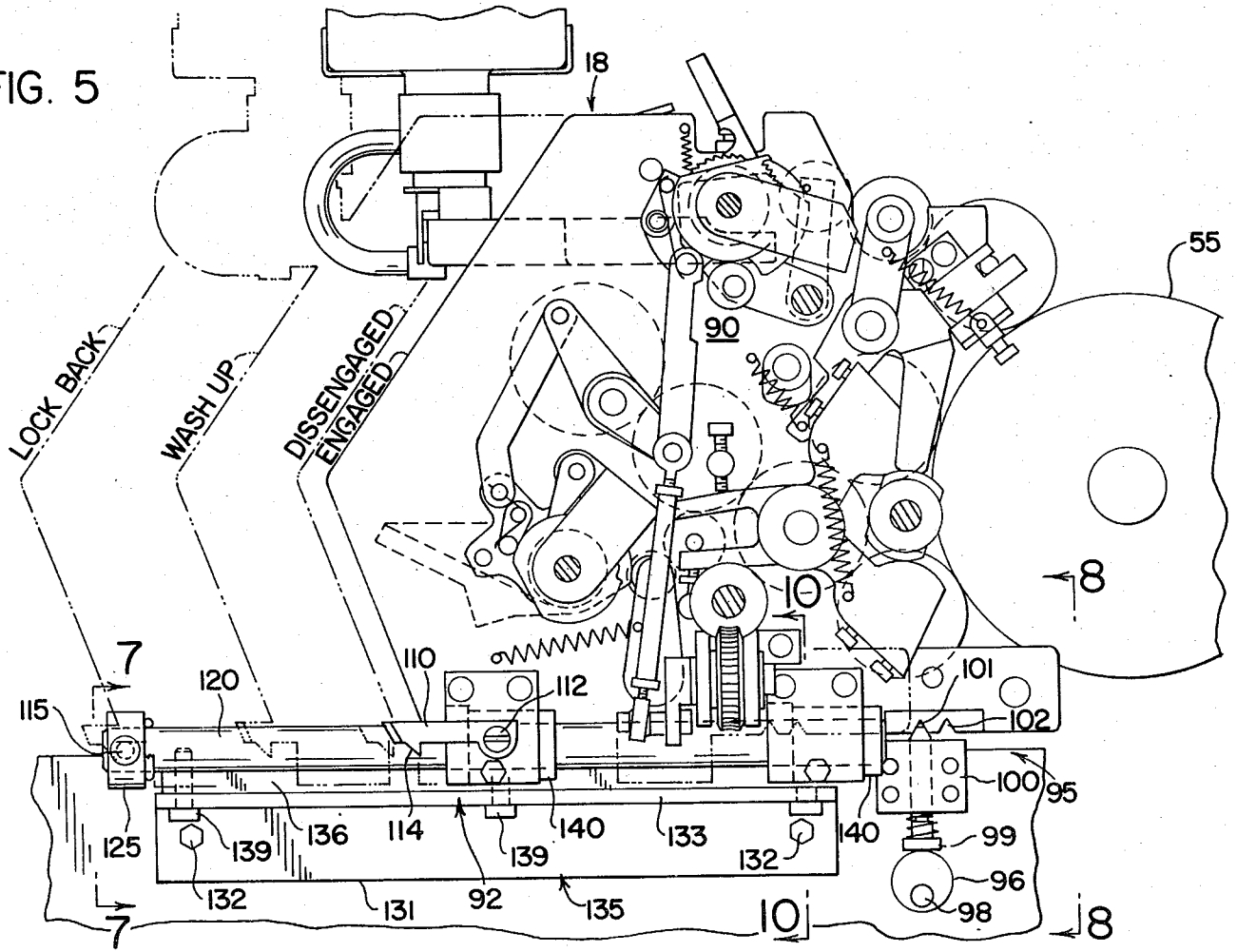
FIG. 5 is an operator's side, elevation view of the movable linking and dampening roller-containing carriage illustrating various carriage positions.
Figures 6, 7:
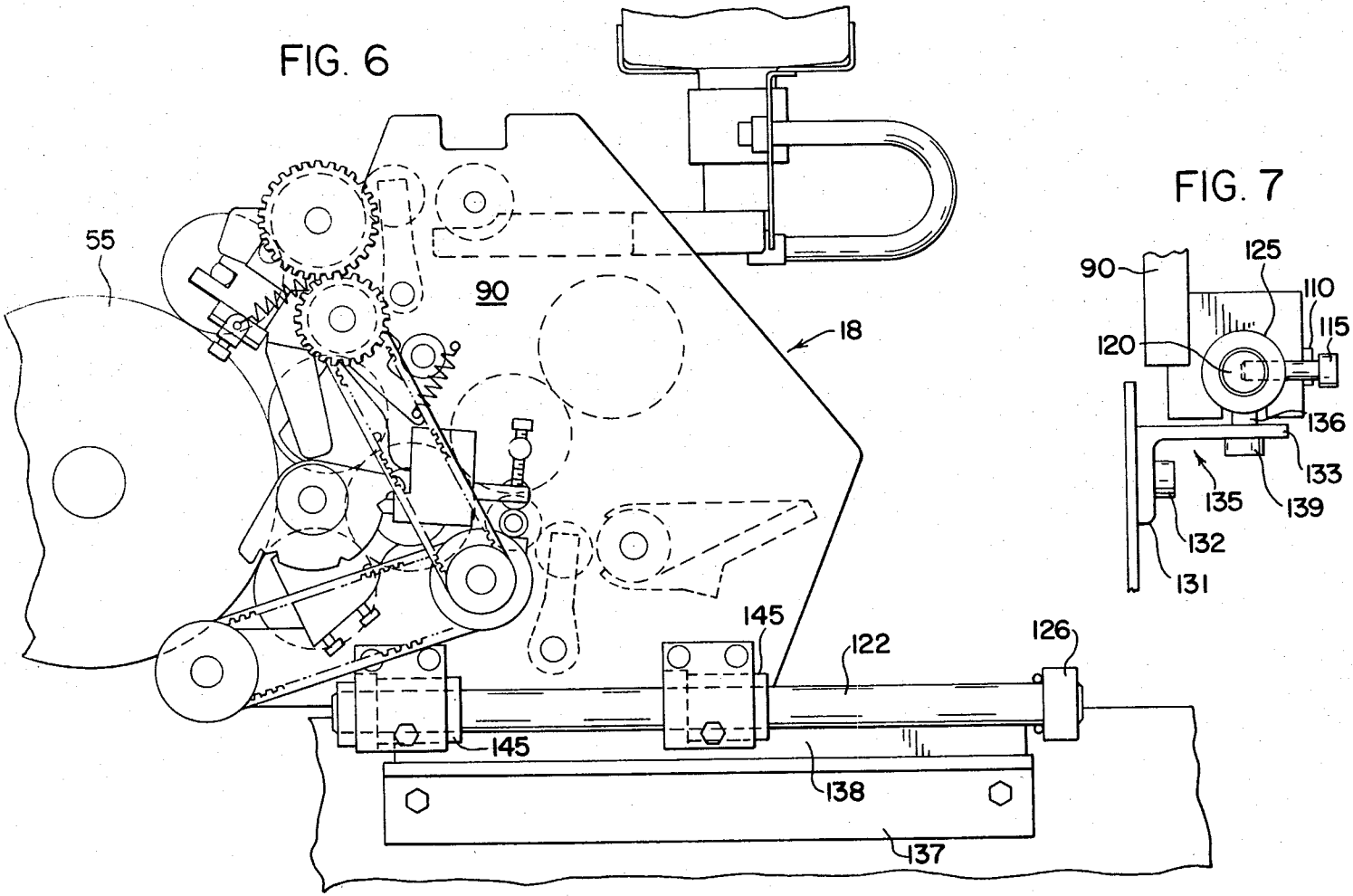
FIG. 6 is a nonoperator's side, elevation view of the movable inking and dampening roller-containing carriage supported by linear motion ball bushings.
FIG. 7 is an end view of a portion of the carriage mounting means taken along line 7—7 of FIG. 5.

Turning to FIGS. 5 and 6, a more detailed illustration of the carriage 18 is presented from the operator's side as shown by FIG. 5 and from the opposed or nonoperator's side shown in FIG. 6. The carriage rides upon a pair of straight parallel rails 120 (FIG. 5) and 122 (FIG. 6) which are supported by and mounted relative to the mainframe of the press. The carriage is movable along the rails 120, 122 between a pair of lock-back, end stop, ringlike collars 125, 126 and the printer head 16 with which the carriage abuts in its engagement position. The collars 125, 126 fit around the rails 120,122 not immediately adjacent to the printer head 16 and are locked to their respective rails 120, 122 by, for example, appropriate setscrews.

The rails are each supported along substantially their entire lengths by an associated pair of L-shaped cross section lengths of angle iron 135, 137 and by generally equal parallel extending lengths of generally-rectangular cross section bar stock 136, 138 positioned between and engaging the angle iron lengths 135, 137 and the respective rails 120, 122. The rails 120, 122, the lengths of bar stock 136, 138, and the lengths of angle iron 135, 137 are rigidly fixed to each other by appropriate fastening means, such as bolts, welds or the like. The lengths of angle iron 135, 137 are in turn rigidly fastened to the press fame. Thus, straight rails 120, 122 rigidly fixed relative to the press frame are parallel to each and extend along and are parallel to an axis normal to the axis of rotation of the second plate cylinder 55 (FIG. 4). The set of dampening and inking rollers 90 have axes of rotation which are normal to the linear motion direction of the carriage and parallel to the axis of rotation of their associated plate cylinder 55.

As illustrated in FIGS. 5 and 6, the carriage 18 having a generally rectangular base area rides the rails 120, 122 on supportive rolling friction bearing means in the form of two pairs of linear motion partial ball bushings 140, 145, each pair riding a respective rail 120, 122. Such mounting of the carriage structure advantageously provides positive linear motion of the carriage 18 toward the printer head 16 without lateral or skewing movements of the carriage 18 relative to the printer head 16, which could cause misalignment between the set of inking and dampening rollers 90 and the respective second plate cylinder 55.

Turning to FIG. 7, it can be seen that the length of angle iron 135 has a vertically extending leg 131 which is fastened to the press frame by appropriate bolts 132 (only one illustrated). A horizontally extending leg portion 133 of the length of angle iron 135 supports the generally equal length of bar stock 136 which has a generally rectangular cross section (shown more clearly in FIG. 8). The length of bar stock 138, as illustrated in FIG. 7, is held in place against the horizontally extending flange 133 by appropriate bolts 139 (only one shown). The lock-back collar 125 fastened to an end of the rail 120 farthest from the printer head 16 has extending from it in a generally horizontal direction outwardly from the carriage the keeper 115 with which the latch member 110 engages when the carriage is in its lock-back position (FIGS. 4 and 5) as illustrated and earlier discussed with regard to FIG. 4.

Turning to FIG. 8, the mounting of the carriage 18 upon the rails 120, 122 is further illustrated. It can be seen that the ball bushings 140, 145 extend only partially about the circumferential extent of the rods 120, 122. Such linear motion partial ball bushings are further illustrated in FIGS. 9 and 10, where it can be seen that a series of circulating ball bearings move in a line along the longitudinal extent of the rail 20. In FIG. 10 it can be seen that the weight of the carriage is substantially supported only by the lines of recirculating ball bearings so as to provide only rolling friction forces between the carriage and the rail upon which it is movable. Linear motion partial ball bushings of the type illustrated are known in the art and available from Thomson Industries, Inc. of Manhasset, N.Y. With regard to the rail 122 and its related ball bushings 145, it should be noted that their structural relationship to each other is generally identical to the structural relationship between the other rail 120 and ball bushings 140 as discussed with regard to FIGS. 7, 9 and 10.

Figure 11:
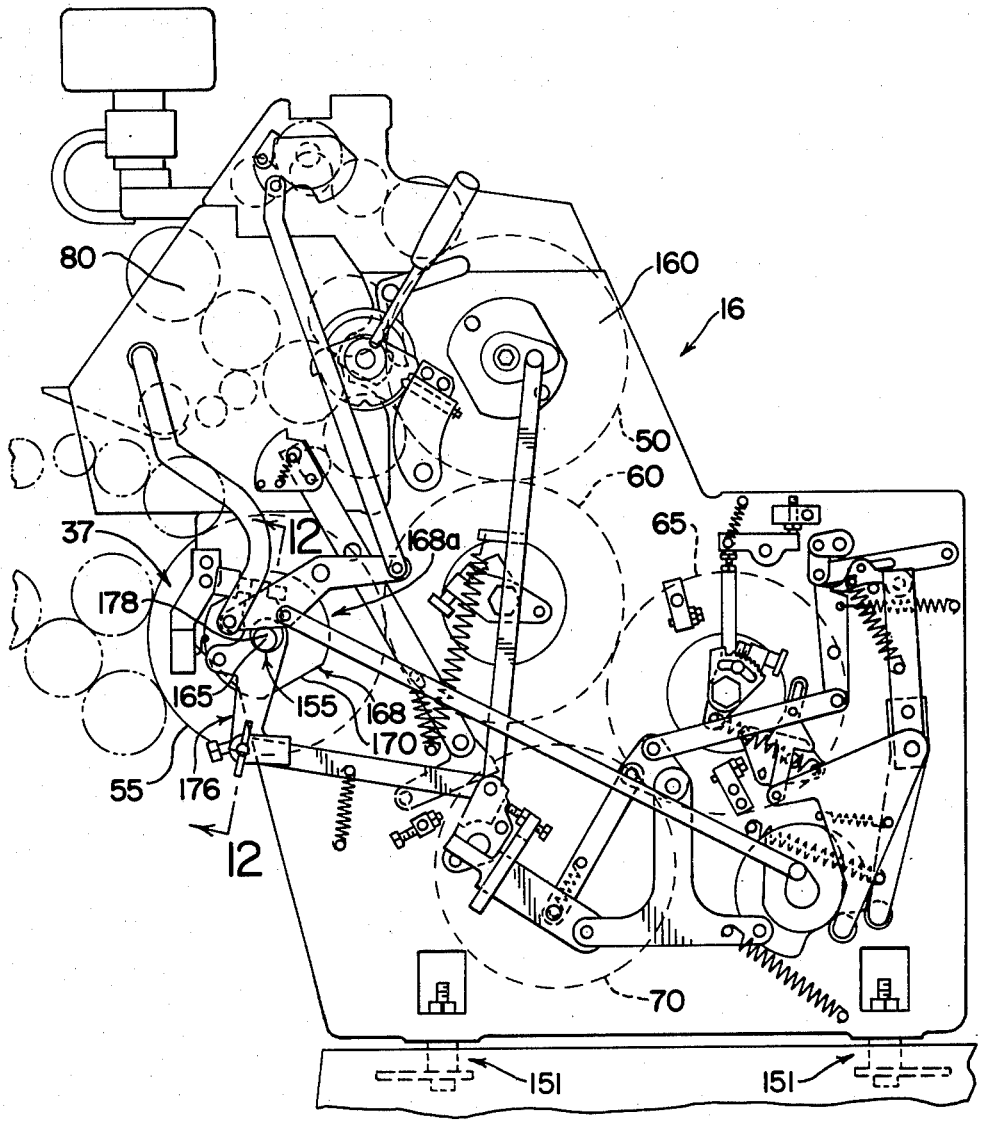
FIG. 11 is an operator's side, elevation view of the printer head of the press.

Turning to FIG. 11, there is illustrated in more detail from the operator's side the printer head 16 which is mounted on and fixed to the mainframe 10 of the press using a plurality of supportive bolts 151. The printer head 16 has rotatably mounted on it the plurality of parallel oriented and generally abutting cylinders in the form of the first plate cylinder 50, the second plate cylinder 55, the blanket cylinder 60, the impression cylinder 65, and the delivery cylinder 70. The rotatable mounting of the second plate cylinder 55 utilizes an eccentric mounting 155 well-known in the art which permits limited translational shifting of the second plate cylinder 155 to and away from the blanket cylinder 60 where, for example, only a single-color operation is required when only the plate cylinder 50 is engaged with the blanket cylinder 60. Such translational shifting of the plate cylinder 55 causes opening and closing of the switch means 37 (FIG. 1) illustrated in FIG. 11 as a microswitch response to press linkage movements associated with the noted translational movement of the plate cyiilinder 55. The utilization of the switch means 37 will be discussed in more detail with regard to the press safety interlock system. The control linkage illustrated in FIG. 11 is of the typical type.

Figure 12:
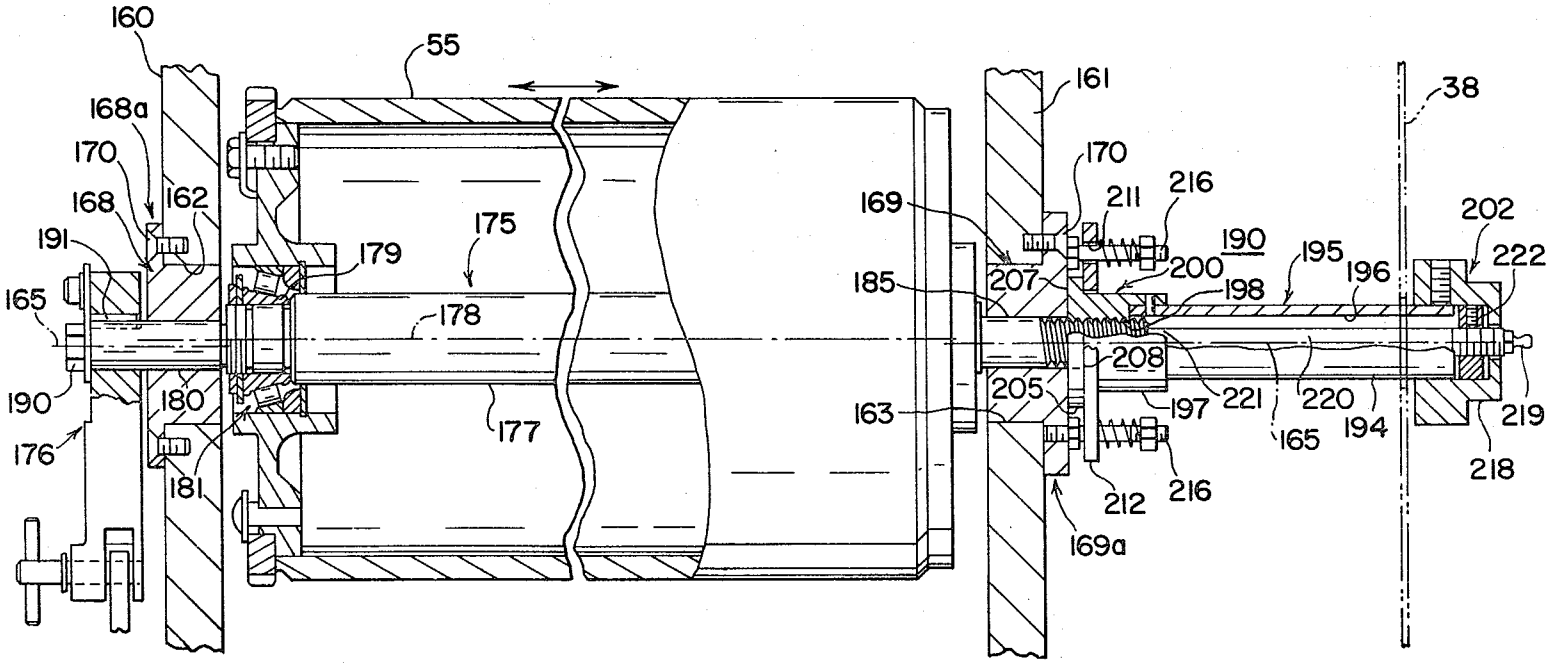
FIG. 12 is a longitudinal cross section view of the axially adjustable plate cylinder taken along line 12—12 of FIG. 11.

With reference to FIG. 12, there is illustrated in longitudinal across section an operator-accessible mechanism for axially adjusting the second plate cylinder 55 to establish proper superposition or registry of the two-plate cylinder images transferred to the blanket cylinder as explained earlier.

The second plate cylinder 55 is rotatably mounted on and between two opposed and parallel printer head frame members 160, 161. Opposed, cylindrical, aperture-defining walls 162, 163 concentric with a common axis 165, each engagingly receive respective concentric, cylindrical, ringlike bushings 168, 169, which each include respective radially extending flange portions **168*a*, 169*a*. The bushings 168, 169 are fixed within the apertures defined by the walls 162,163 to their respective frame members 160, 161 by appropriate screw fasteners 170**.

Extending between the bushings 168,169 is a plate cylinder shaft 175 which has a cylindrical midportion 177 having an axis of revolution 178 which is eccentrically set off by a predetermined amount from the axis 165 along which the concentric bushings 168,169 are oriented. The shaft 175 further includes a non-threaded cylindrical end portion 180 received by the bushing 168. The shaft 175 further includes a threaded cylindrical end portion 185 received by the bushing 169. The cylindrical end portions 180,185 lie along their common axes of revolution 165, while the shaft midportion 177 lies along its axis of revolution 178. The two axes 165,178 are parallel to each other wherein the end portions 168,169 of the shaft are eccentric by an equal radial and angular degree relative to the shaft midportion 177. Both of the axes 165,178 are normal to the parallel plane defined by the frame members 160,161 to provide parallel positioning of the second plate cylinder 55 relative to the blanket cylinder 60 (FIG. 11), which is also mounted along an axis normal to the planes defined by the frame members 160,161.

The plate cylinder 55 is rotatably mounted upon reduced end portions 179 (only one shown) of the midportion 177 of the shaft 175. Suitable bearing means, such as tapered roller bearings 181 (only one shown), are utilized at each end of the cylindrical plate cylinder 55 to rotatably mount it on the shaft 175 which is generally not rotatable around the axis 178. The shaft 175 is axially movable to a limited degree between the frame members 160,161 by being axially slidably and rotationally received within the bushings 168,169.

Limited translational movement of the plate cylinder 55 to and from and into and out of engagement with the associated blanket cylinder 60 (see FIG. 11) is provided by rotation of the eccentric end portions 180,185 on the axis 165, such end portion rotation causing the noted translational movement of the shaft midportion 177 and the associated rotationally mounted plate cylinder 55. A suitable linkage 176 (as further illustrated in FIG. 11) is utilized to rotate to a limited degree the shaft end portions 180,185 to provide the noted translational movement of the rotatably mounted cylinder 55. The linkage 176 is fixed to the distal end of the nonthreaded end portion 180 by means of a bolt 190 and shaft key means 191 to limit the degree of rotation of the shaft 175 to substantially less than a full revolution. The use of such eccentric cylinder mountings (Also see element 155, FIG. 11) is well-known in the art, and such mountings can be adapted to any of the cylinders or rollers of the press where such a translational movement function is desirable.

To adjust and maintain the position of the axially movable shaft 175 slidable within the ringlike bushings 168,169, an adjustment mechanism 190 is provided in accordance with the invention. The mechanism 190 includes a spindle 195 having a shaft-engaging end 200 and an operator-accessible distal end 202 which extends through the printer head cover 38 for operator access. The spindle 195 is rotatable on the axis 165, and in a preferred form includes a tube having outer and inner cylindrical walls 194,196. The shaft-engaging end 200 of the spindle 195, which further includes a ringlike collar 197, is threaded on its inner cylindrical wall 198 to engagingly receive the threaded end portion 185 of the shaft 175. While the spindle 195 is rotatable about the axis 165, it is generally not translationally movable along the axis 165. On the other hand, the spindle 175, while axially movable to a limited degree, is in general not rotatable about the axis 178, but for the limited degree of eccentric shaft rotation to cause the earlier-discussed translational movement of the cylinder 55. It can be seen that rotation of the spindle 195, which is generally fixed axially, will cause axial movement of the generally nonrotatable shaft 175. The degree of movement caused by a single revolution or rotation of the spindle 195 depends upon the thread pitch of the threaded end portion 185.

To maintain a set axial position of the shaft 175 and its rotatably mounted plate cylinder 55, a friction biasing means is provided to lock the spindle at a particular rotational location and to substantially limit axial movement of the rotatable spindle 195. In a preferred form, the friction biasing or locking means includes a spindle flange portion 205 extending radially from the shaft-engaging end portion 200 of the spindle 195. The flange portion 205 provides first and second annular friction engaging faces 207, 209 which are concentric with the spindle 195. The first annular face 207 engages with a corresponding annular area of the frame provided, as illustrated, by the bushing flange portion 169*a*. The second annular face 208 frictionally engages with a corresponding opposed annular area provided by a ringlike member 212 which is biased against the second annular face 208 of the flange 205 by appropriate helical spring means 214 extending between the distal ends of studs 216 extending normally from the frame member 161, the studs 216 having lengths substantially in excess of the thick of the flange 205, as illustrated. The studs 216 are equidistantly spaced about the spindle 195 and project through correspondingly equidistant space apertures 211 through the ring member 212. Spring biasing of the ring member 212 against the flange 205 effectively sandwiches the flange between the biased ring member 212 and the bushings 169 to limit axial movement of the rotatable spindle 195. The clutching effect provided between the annular faces 207, 208 and the respective mating annular portions of the bushing 169 and ring member 212 act as an effective means to maintain the axial position of the plate cylinder 55 once it has been set by operator turning of the spindle end 202, which may include a knob 218 fixed thereto. A conventional grease fitting 219 is fixed to the distal end of a hollow rod 220 having its other end 221 threaded into an axial bore (not shown) through the spindle 185, the axial bore communicating with the pair of roller bearings 181. Lubricant is applied under pressure via the grease fitting 219, the hollow rod 220, and the spindle axial bore (not shown) to the roller bearings 181. Also fixed about the rod 220 at its distal end is a ring-like stop member 222 which moves between the distal end of the spindle 195 and the knob 218, as illustrated, to limit the range of axial movement of the plate cylinder 55.

Figure 13:
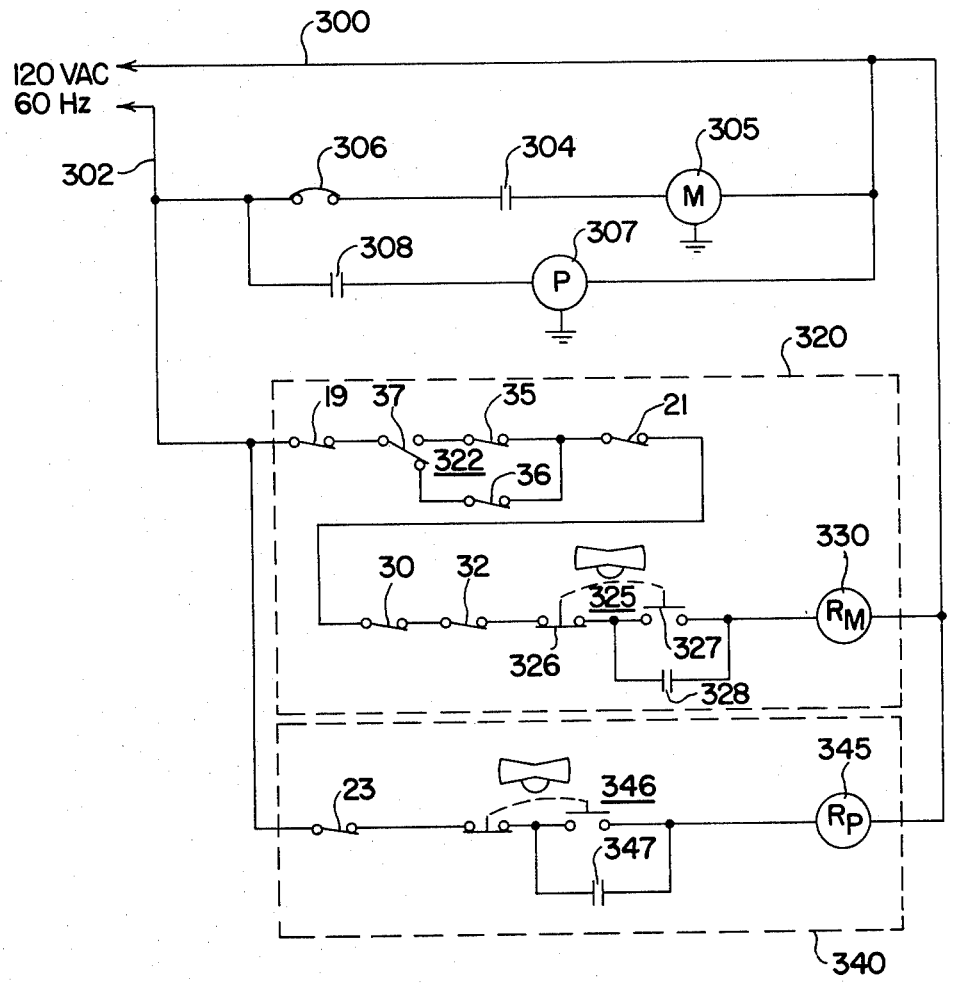
FIG. 13 is a schematic diagram of the printing press safety interlock system.

With reference to FIG. 13 and FIG. 1, the earlier-discussed interlock control system for ensuring safe operation of the press of the present invention will now be discussed in further detail. FIG. 13 is a generally schematic diagram of the interlock control system in accordance which the invention with incorporates the earlier noted switching means 19, 21, 23, 30, 32, 37, as geometrically located and as functionally described with regard to FIG. 1. The interlock system includes a conventional pair of power lines 300, 302. Extending across the power lines 300,302 in parallel relation for electrical energization are a press motor 305 and a paper handling vacuum pump 307. Electrically connected between the power lines 300,302, and in series with the press motor 305, is a fuse 306 of the conventional type and a set of normally open relay contacts 304. It can be seen that power will be applied to the press motor 305 when the normally open contacts 304 are closed. In likewise fashion, a set of normally open relay contacts 308 are provided in series with the vacuum pump 307 wherein closing of the contacts 308 applies power to the pump 307, the vacuum pump providing paper to the printer head 16 (FIG. 1) from the paper feed input 12. The operation of the vacuum pump 307 and its utilization in the paper feed input 12 are well-known in the art. Also connected across the power lines 300, 302 are a motor control circuit 320 and a vacuum pump control circuit 340.

The motor control circuit 320 includes, in serial relation and in electrical series relationship between the power lines 300, 302, the paper delivery interlock switch means 19, a carriage/printer head interlock switch means 322 which includes switching means 35, 36, 37, the other paper delivery interlock switch means 21, the printer head movable cover interlock switch means 30, 32, an on-off rocker switch 325, and a motor relay 330.

In operation, the rocker switch 325, having two sets of serially connected contacts 326, 327 and illustrated in its at-rest position, is momentarily switched by the operator to an on condition wherein the set of contacts 327 close. If all of the press interlock switch means (19,322,21,30,32), disregarding switch means 23, are in their proper condition, as will be subsequently explained, power is applied to the press motor relay 330. Upon power actuation to the press motor relay 330, the set of press motor contacts 304 are closed to apply power to the press motor 305. Also closed by the actuation of the relay 330 are a set of latching contacts 328 which parallel and bridge the contacts 327, which, after being momentarily closed by the operator, are returned to the position illustrated such that the contacts 327 are opened and the latching contacts 328 are closed or latched. The relay continues to be powered and to maintain the motor contacts 304 in a closed condition for press motor energization. To turn off the press motor, the operator need only push the rocker switch 325 to its off position wherein the contacts 326 are momentarily open to deenergize the relay 330 and to open the latching contacts 328 and the motor contacts 304. Return of the contacts 326 to their illustrated at-rest, closed position will not affect the deenergized condition of the press, since both sets of contacts 327 and 328 are now open.

The functioning of the various safety interlock switches within the press motor control 320 will now be discussed.

With the press in an on condition, with the relay 330 being energized via the closed latching contacts 328, the press will continue to run unless an unsafe condition is presented in the form of, for example, an open condition of any of the covers 15, 17, 24 or 26, as earlier explained with respect to FIG. 1. The opening of the noted covers during an operating condition of the press would actuate their respective interlock switches 19, 21, 30 or 32 to an open circuit condition. Opening of any of these series of connected interlock switches 19,21,30,32 will deenergize the relay 330 and shut down the press motor 305 due to the opening of contacts 304, as explained earlier. With regard to the series-connected carriage/printer head interlock control 322, the printer head interlock switch means 37 switches between its two illustrated positions as a function of translational movement of the second plate cylinder to (engagement) and away from (disengagement) of the blanket cylinder. The carriage interlock switches 35 and 36, on the other hand, are actuated in accordance with the degree of carriage movement away from the printer head. The switch means 35, 36, 37 cooperate together to limit operator access to the moving plate cylinder when it is turning as a result of engagement with the blanket cylinder and actuation of the press motor 305. With the carriage at its engaged position and with the second plate cylinder engaged with the blanket cylinder, switch 37 is positioned as illustrated in FIG. 13, switching means 36 is closed, and switching means 35 is open. Under these switch conditions, the press motor operates in a normal manner. With the carriage moved to its disengaged position 105 (FIG. 4) the switch means 36 opens and the press motor will not operate until the second plate cylinder is shifted translationally away from and out of engagement with the blanket cylinder. Such shifting of the second plate cylinder throws the switch 37 from the position shown in FIG. 13 to its other position wherein it is in series with switch means 35, which is now closed as a result of carriage movement away from the printer head to the disengagement position. At the wash-up position 106 (FIG. 4) of the carriage, switch means 26 is open and switch means 35 is closed. Press motor actuation for driving of the carriage dampening and inking rollers 80 (FIG. 4) for wash-up purposes can only occur when interlock switch means 37 is in its other position, i.e., when it is actuated by translational movement of the second plate cylinder away from the blanket cylinder so that the cylinder will not rotate, thus exposing the operator to an unsafe position. Finally, when the carriage is moved all the way back to its lock-back position 107, both carriage interlock switch means 35, 36 are in an open circuit condition and the press motor will not operate regardless of the position of the plate cylinder actuated interlock switch means 37. Thus, it can be seen that the press motor interlock switch means 320 provides quick deenergization of the press whenever an unsafe operating condition, as earlier discussed, exists.

Turning to the vacuum pump control circuit 340, a second relay 345 is connected between the power lines 300 and 302 via a series-connected second rocker switch means 346 and the bin overload interlock switch means 23. The rocker switch means 346 functions in the manner similar to that as earlier explained with regard to rocker switch 325, wherein moving of the rocker switch 346 to an on position energizes the vacuum pump relay 345 and its latching contacts 347, and vacuum pump contacts 308, which in turn energize the vacuum pump 307. When an overload condition within the bin 30 (FIG. 1) is sensed by the interlock switch means 23, opening of interlock switch 23 deenergizes the vacuum pump relay 345, which in turn opens contacts 308 and 347. Reenergization of the vacuum pump motor 307 requires that the operator once again momentarily move the rocker switch 346 to its on condition after the printed paper has been removed from the bin 30 (FIG. 1) to reset the interlock switch means to a closed position.

Although a preferred embodiment of this invention is illustrated, it should be understood that various modifications and rearrangements of parts may be resorted to without departing from the scope of the invention disclosed and claimed herein.

What is claimed is:

1. An offset printing press comprising:

a mainframe including paper handling means, the paper handling means defining a paper handling path extending between a paper feed input and a paper delivery output;

a printer head mounted on and fixed to the mainframe and engageable with the paper handling path at a location generally intermediate the paper feed input and the paper delivery output, the printer head including a single blanket cylinder and a pair of plate cylinders, the plate cylinders being simultaneously engageable with the blanket cylinder, the plate cylinders and blanket cylinder being adjacent to each other and rotatably mounted on the printer head along generally parallel axes, the blanket cylinder being adapted to simultaneously transfer images from the plate cylinders to paper provided by the paper handling means;

a movable carriage mounted on the mainframe and located generally adjacent to the printer head, the carriage being substantially linearly movable along a generally straight line to and from the printer head, the carriage having a rectangular base including four linear motion ball bushings and located at a respective one of the four corners of the rectangular base, the mainframe including a pair of parallel rails upon which the ball bushings ride, the ball bushings engaging the rails to substantially eliminate carriage movement in directions generally perpendicular to the straight line along which the carriage moves, the carriage being positively lockable at predetermined positions along the generally straight line of linear movement;

a first set of dampening and inking rollers rotatably mounted on and fixed to the printer head and engageable with one of the plate cylinders; and a second set of dampening and inking rollers rotatably mounted on and fixed to the carriage and engageable with the other of the plate cylinders when the carriage is moved toward the printer head to an engagement position.

2. An offset printing press according to claim 1, wherein the rails are circular cross sectional rods supported along substantially their entire lengths by the mainframe.

* * * * *

UNITED STATES PATENT AND TRADEMARK OFFICE

CERTIFICATE OF CORRECTION

PATENT NO. : 4,222,325
DATED : September 16, 1980
INVENTOR(S) : Robert Edwards

It is certified that error appears in the above—identified patent and that said Letters Patent is hereby corrected as shown below:

Column 2, Line 15, (2d line of Fig. 5) - "linking" should be -- inking --.

Column 5, Line 34, under caption "Detailed Description of the Preferred Embodiment" - "is" should be -- in --.

Column 7, Line 32, after the word "rail" "20" should read -- 120 --.

Column 10, Line 9, after the word "invention" "with" should read -- which --.

Column 11, Line 44, - "26" should read -- 36 --.

Column 12, Line 6, - "30" should read -- 20 --.

Column 12, Line 13, - "30" should read -- 20 --.

Signed and Sealed this

Eighteenth Day of November 1980

[SEAL]

Attest:

SIDNEY A. DIAMOND

Attesting Officer

Commissioner of Patents and Trademarks